US007896134B2

(12) United States Patent
Morris et al.

(10) Patent No.: US 7,896,134 B2
(45) Date of Patent: Mar. 1, 2011

(54) LOW-RISE VERTICAL PLATFORM LIFT ASSEMBLY WITH LOW-PROFILE LIFTING MECHANISM

(75) Inventors: Donald Morris, Conifer, CO (US); Alan R. Cohn, Lockeford, CA (US); Roger Young, Waterford, CA (US)

(73) Assignee: Lift-U, division of Hogan Mfg., Inc., Escalon, CA (US)

( * ) Notice: Subject to any disclaimer, the term of this patent is extended or adjusted under 35 U.S.C. 154(b) by 340 days.

(21) Appl. No.: 11/590,247

(22) Filed: Oct. 30, 2006

(65) Prior Publication Data

US 2008/0101905 A1 May 1, 2008

(51) Int. Cl.
*B66F 9/02* (2006.01)

(52) U.S. Cl. ..... 187/200; 187/267; 187/269

(58) Field of Classification Search ..... 187/200, 187/211, 214, 267, 269
See application file for complete search history.

(56) References Cited

U.S. PATENT DOCUMENTS

| | | | | |
|---|---|---|---|---|
| 5,180,275 | A * | 1/1993 | Czech et al. | 414/541 |
| 5,379,655 | A * | 1/1995 | Yeakle | 73/865.7 |
| 6,109,395 | A * | 8/2000 | Storm | 187/200 |
| 6,182,798 | B1 | 2/2001 | Brady | |
| 6,651,775 | B2 * | 11/2003 | Bassett, Jr. | 182/69.5 |
| 7,225,898 | B2 * | 6/2007 | Bourgeois | 187/200 |
| 7,413,056 | B2 * | 8/2008 | Gonzi et al. | 187/269 |
| 7,461,722 | B2 * | 12/2008 | Kyotani | 187/269 |
| 2003/0047388 | A1 | 3/2003 | Faitel | |
| 2006/0180403 | A1 * | 8/2006 | Hanlon | 187/269 |
| 2007/0235266 | A1 * | 10/2007 | Dantas et al. | 187/269 |

FOREIGN PATENT DOCUMENTS

| | | | | |
|---|---|---|---|---|
| JP | 4-133999 | A * | 5/1992 | 187/269 |

* cited by examiner

*Primary Examiner*—James Keenan
(74) *Attorney, Agent, or Firm*—Christensen O'Connor Johnson Kindness PLLC

(57) ABSTRACT

A wheelchair lift assembly is provided. The wheelchair lift assembly includes a frame, a platform, and a lift mechanism associated with the frame. The lift mechanism includes a stabilizing arm and at least one lift arm member having a first end connected to the platform. The first end of the lift arm member pivots and translates relative to the platform as the platform is reciprocated between raised and lowered positions. The wheelchair lift assembly also includes a drive assembly. The drive assembly selectively provides a driving force to the lift mechanism without directly providing the driving force to the stabilizing arm.

27 Claims, 6 Drawing Sheets

LOW-RISE VERTICAL PLATFORM LIFT ASSEMBLY WITH LOW-PROFILE LIFTING MECHANISM

BACKGROUND

Persons with mobility impairments often depend on a wheelchair or walking aid to facilitate mobility. As a result, they are frequently subjected to physical barriers and obstacles such as stairs and curbs. The ADA legislation requires that these physical barriers be removed. Ramps provide some access; however, ramps can be very long and difficult to climb. Further, depending on the elevation change and available space, ramps may be impractical. One solution is a wheelchair lift. Wheelchair lifts for commercial buildings and private residences must be designed and tested to meet the requirements of the ASME Code: A18.1, SAFETY STANDARD FOR PLATFORM LIFTS AND STAIRWAY CHAIRLIFTS.

Low-rise platform lifts, or lifts that are limited to 24-inch maximum vertical travel, have been developed for use in courtrooms, church pulpits, meeting chamber podiums, and other similar environments. These types of installations not only provide a means for safe level changes, but must also be sensitive to decorum and surrounding architecture.

As low-rise lifts are being incorporated into new and remodel construction, obstacles are being encountered that require alternative lifting mechanisms to facilitate a simpler and cleaner interface with surrounding millwork finishes. For example, screw column type lifting mechanisms require the screw columns to be encased within the millwork walls, which directly influences and sometimes restricts the placement of screw columns and requires significant modifications to existing decorative finishes.

One suitable lifting assembly is a "scissor-type" lifting mechanism. Such lifting mechanisms typically have very high lifting ratios at the lower range of platform travel, and very low lifting ratios at the upper range of platform travel. This ratio differential causes the platform speed to vary throughout the range of vertical travel, which typically must be overcome with the use of hydraulics. Hydraulic systems are undesirable as they are known to bleed or leak over time.

Scissor mechanisms also tend to have a profile larger than desirable, as space is required within the scissor envelope for the actuator (or actuators). This space problem is often overcome with the use of a pit under the lift to house the actuator. However, retrofit applications often do not have sufficient pit space available. As a result, scissor lifts are undesirable in applications that require a pit to house actuator of the scissor lift.

Thus, a low-profile lift mechanism, that is discrete, achieves a suitable lifting power, and maintains a relatively constant lifting speed is desired.

SUMMARY

A wheelchair lift assembly is provided. The wheelchair lift assembly includes a frame, a platform, and a lift mechanism associated with the frame. The lift mechanism includes a stabilizing arm and at least one lift arm member having a first end connected to the platform. The first end of the lift arm member pivots and translates relative to the platform as the platform is reciprocated between raised and lowered positions. The wheelchair lift assembly also includes a drive assembly. The drive assembly selectively provides a driving force to the lift mechanism without directly providing the driving force to the stabilizing arm.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION

Figure 1:
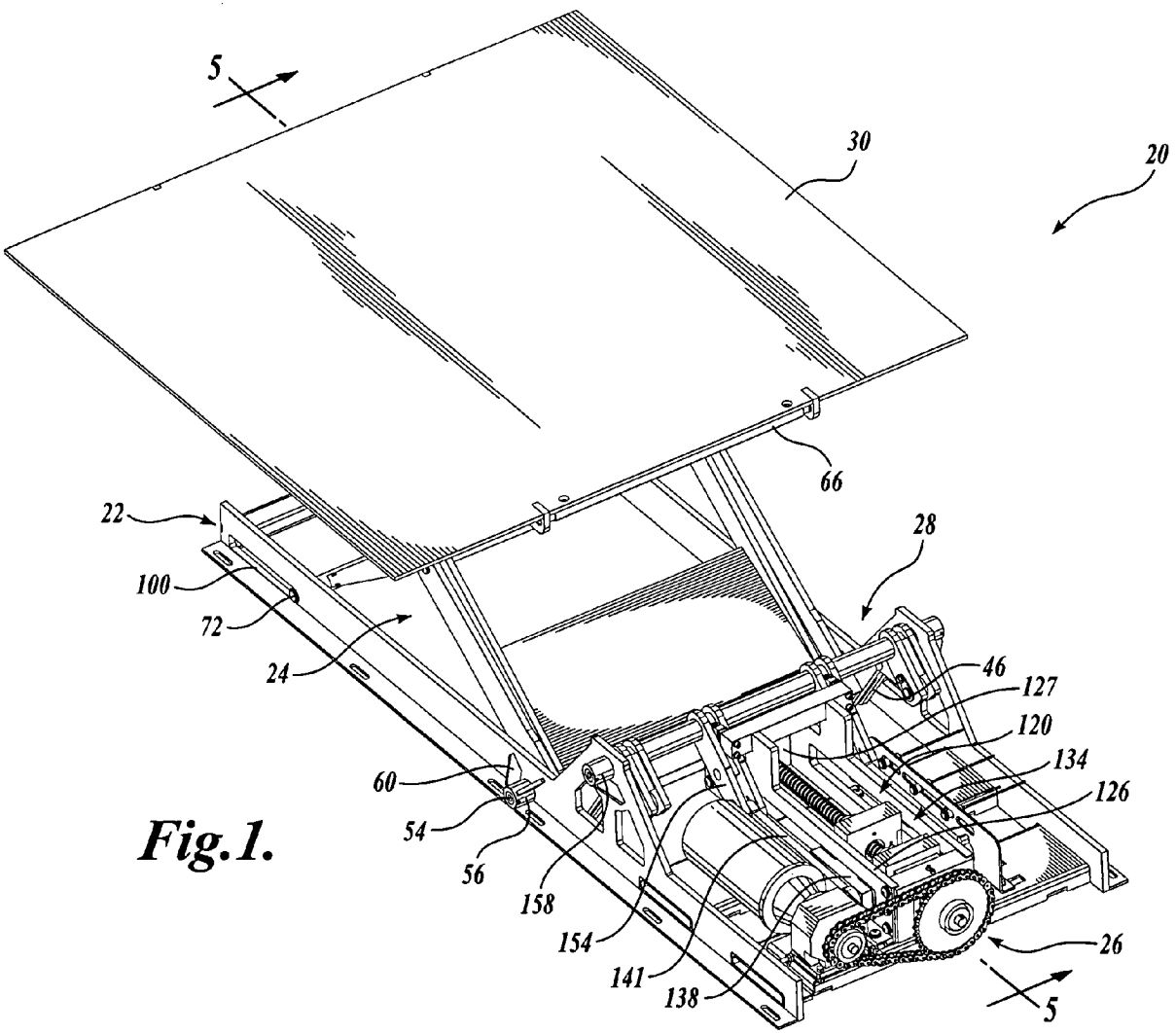
FIG. 1 is an isometric view of the platform lift in the raised position constructed in accordance with one embodiment of the present disclosure.

A low-profile, low-rise vertical platform lift 20 constructed in accordance with one embodiment of the present disclosure is best seen by referring to FIG. 1. The vertical platform lift 20 includes a frame 22 and a lift mechanism 24 slidably received therewithin. Lifting means are used to reciprocate the lift mechanism 24 between a lowered position (see FIG. 6) and a raised position (see FIG. 1). A lift platform 30 is coupled to the lift mechanism 24 so that the lift platform 30 translates between the lowered and raised positions along with the lift mechanism 24. The vertical platform lift 20 is preferably constructed of steel or aluminum, yet any material of suitable strength and durability may be used.

Figure 2:
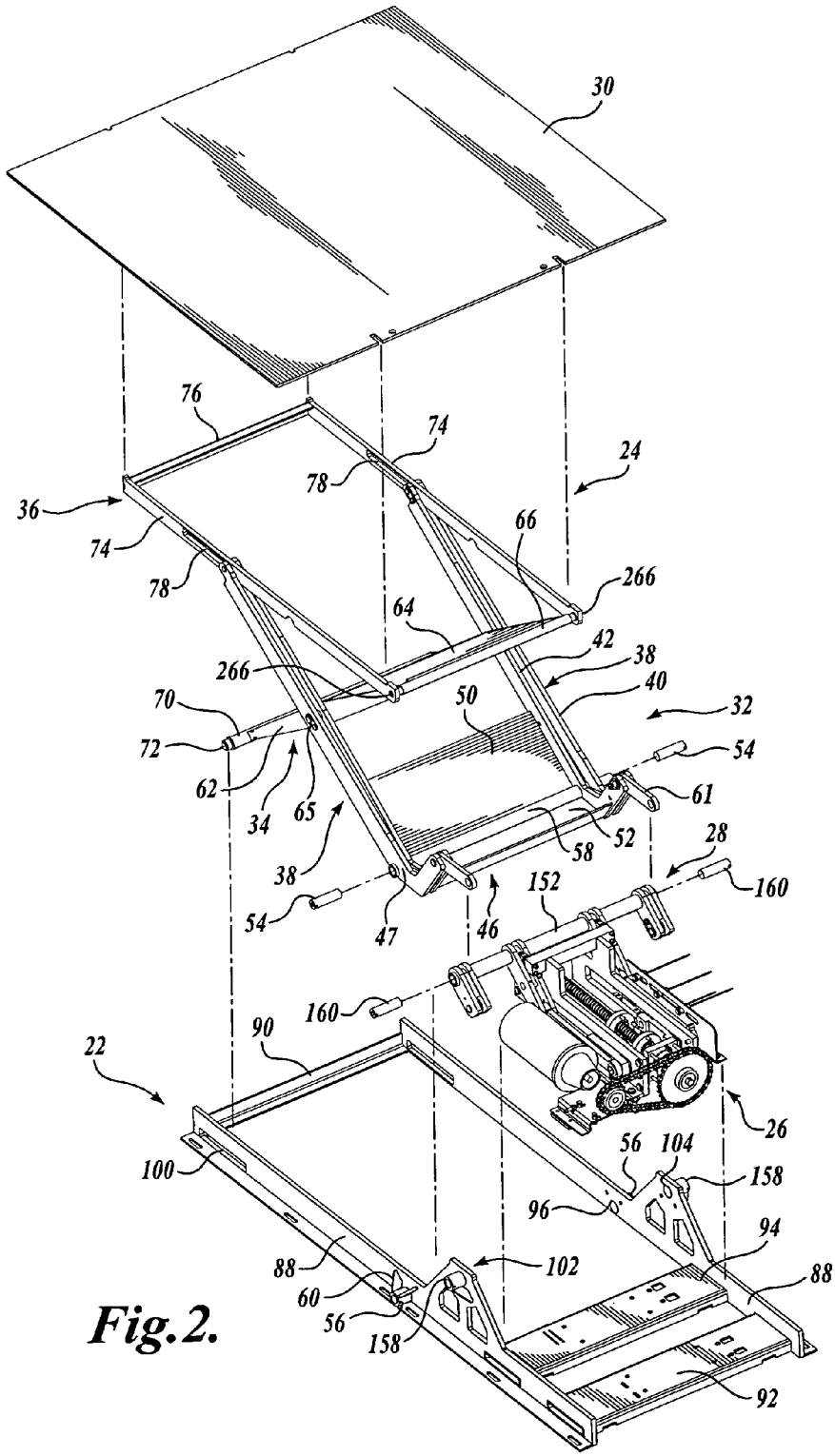
FIG. 2 is an exploded view of the platform lift of FIG. 1.

Now referring to FIG. 2, the frame 22 includes two opposing lateral brackets 88. A rear bracket 90 disposed between the lateral brackets 88 at the distal end of the frame, and first and second cross supports 92 and 94 are disposed between the lateral brackets 88 at the proximal end of the frame 22. The first and second cross supports 92 and 94 may be used for fixedly coupling various components within the frame. The lateral brackets 88 include a first pin aperture 96 disposed opposite one another for receiving the end of a first pin 54.

The lateral brackets 88 further include upwardly projecting portions 102 disposed opposite one another, each having a second pin aperture 104 for receiving the ends of a second pin 160. A first collar 56 and second collar 158 are coaxially aligned with first pin aperture 96 and second pin aperture 104, respectively. The first and second collars 56 and 158 are fixedly coupled to lateral brackets 88 of the frame 22. A plurality of gusset supports 60 are fixedly coupled to lateral brackets 88 and both first collar 56 and second collar 158.

Figure 6:
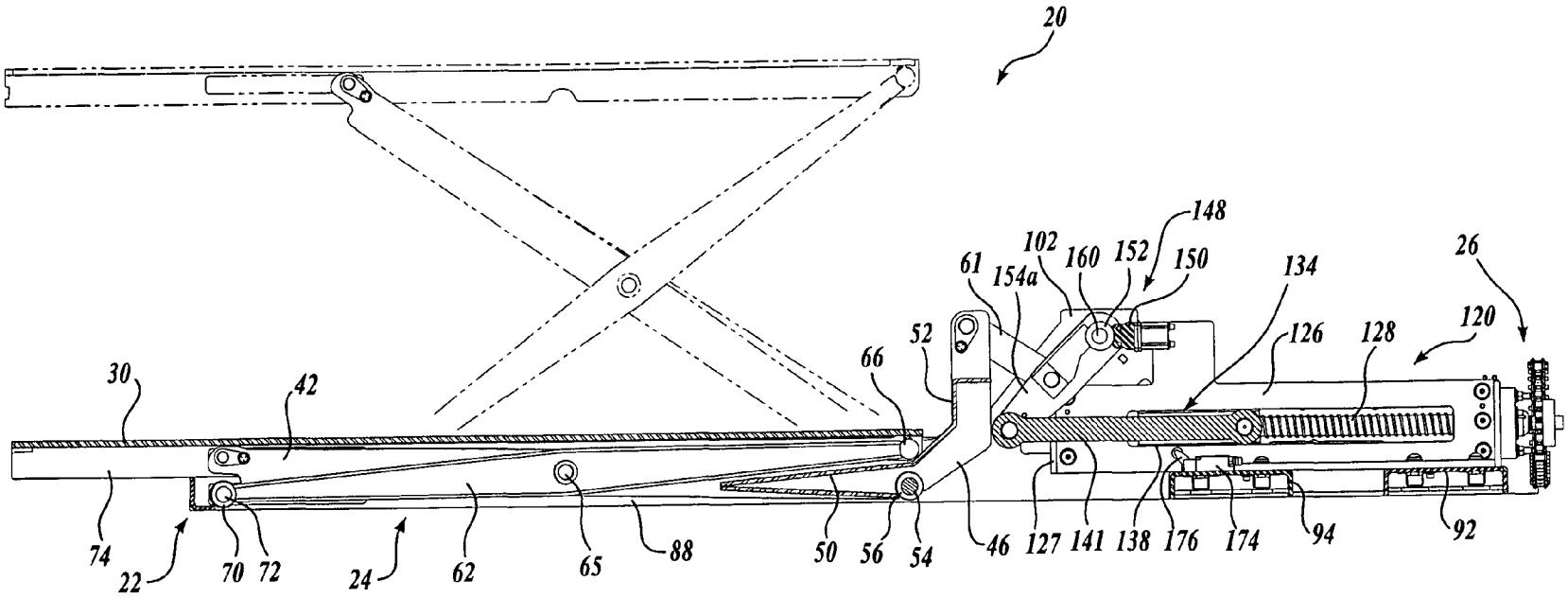
FIG. 6 is a partial cross-sectional view of the platform lift of FIG. 1, taken substantially through Section 6-6 of FIG. 1 and showing the platform lift in the lowered position.

Still referring to FIG. 2, the lift mechanism 24 is pivotally and slidably received within the frame 22. The lift mechanism 24 includes a main lift arm assembly 32 pivotally coupled to a stabilizing arm assembly 34. The main lift arm assembly 32 includes two main lift arms 38, each having an outer lift arm member 40 and an inner lift arm member 42. The main lift arms 38 are rigidly coupled to one another with a first connecting plate 50 that extends therebetween; however, it should be appreciated that the main lift arms 38 may instead be independent of one another. As shown in FIG. 6, the first connecting plate 50 is tapered in cross-section, with the plate 50 decreasing in thickness as the plate 50 extends toward the midpoint of the main lift arms 38.

The main lift arms 38 include bent portions at one end that are rigidly coupled to one another with a second connecting plate 52 to enhance strength and durability of lift arms 38; however, it should be appreciated that the bent portions of the main lift arms 38 may instead be independent of one another. The bent portions of the main lift arms 38 define a second end 46 having a lever pivot point 47. A pushrod 61 is pivotally coupled to the end of each main lift arm 38, or the second end 46, for transmitting force from the crank assembly 28 (described in detail below) to the lift mechanism 24.

A first hollow shaft 58 passes through the main lift arms 38 at the lever pivot point 47. The first end of the first pin 54 passes through first collar 56 and first pin apertures 96 formed opposite one another in each lateral bracket 88, wherein the first ends of first pins 54 protrude into first hollow shaft 58. The second ends of first pins 54 are thereafter received within first collars 56. A retaining pin or similar device passes transversely through the first collar 56 and the second end of first pin 54 to prevent the first pin 54 from rotating within the first collar 56. Thus, hollow shaft 58 and main lift arms 38 are pivotally coupled to frame 22 with first pins 54.

A bearing member may be disposed within the first hollow shaft 58 between the first hollow shaft 58 and the first pin 54. Any suitable bearing member, such as a ball bearing assembly, roller bearing assembly, or bushing may be used.

It can be appreciated that the first end of first pin 54 could be fixedly attached to first hollow shaft 58, and the second end of first pin 54 be allowed to rotate in first collar 56. In such an embodiment, a bearing member may be disposed between the first collars 56 and the second end of first pins 54. Accordingly, such embodiments and other variations are within the scope of the present disclosure.

Still referring to FIG. 2, the lift mechanism 24 includes main lift arms 38 and a stabilizing arm assembly 34. The stabilizing arm assembly 34 includes two stabilizing arms 62 pivotally coupled to the interior of the main lift arms 38 by a pin or other suitable device at approximately the midpoint of the stabilizing arms 62 and the main lift arms 38 to form a pivot point 65.

The stabilizing arms 62 may be, but not necessarily, tapered at each end with the widest portion in the middle. It is preferred, but not essential, that the stabilizing arms 62 are rigidly coupled together with a stabilizing arm connecting member 64 to enhance the strength and durability of the stabilizing arms assembly 34. The stabilizing arm connecting member 64 is also tapered at each end. A translating rod 70 is transversely coupled to the lower end of the stabilizing arms 62. The translating rod 70 includes rod pin ends 72 that are pivotally and slidably receivable within longitudinal slots 100 formed in the frame lateral brackets 88.

The upper, or first, ends of the main lift arms 38 and the stabilizing arms 62 are coupled to a platform frame 36. The platform frame 36 is generally rectangular in shape, and it includes two support arms 74 and a rear, transverse member 76 that extends between the rear ends of the supports arms 74. The front ends of the support arms 74 are pivotally coupled to the ends 266 of a connecting rod 66 disposed between the upper ends of the stabilizing arms 62.

The upper ends of the main lift arms 38 are pivotally and slidably received within longitudinal slots 78 formed within the support arms 74 of the platform frame 36. A lift platform 30 is coupled to the top of the lift platform frame 36 with any suitable fastening means to define a lifting area for a passenger. As constructed, the upper ends of the main lift arms 38 pivot and translate within the slots 78 and relative to the lift platform 30 as the lift platform 30 is reciprocated between the raised and lowered positions.

Referring to FIGS. 2 and 6, the design of the lift mechanism 24 allows the main lift arms 38, the stabilizing arms 62, and the platform frame 36 to be collapsible and receivable within the frame 22 such that the lift 20 may be lowered in a low-profile configuration. Moreover, the stabilizing arms 62 and the stabilizing arm connecting member 64 are shown tapered such that they may be nestled within the frame against the first connecting plate 50.

Figure 3:
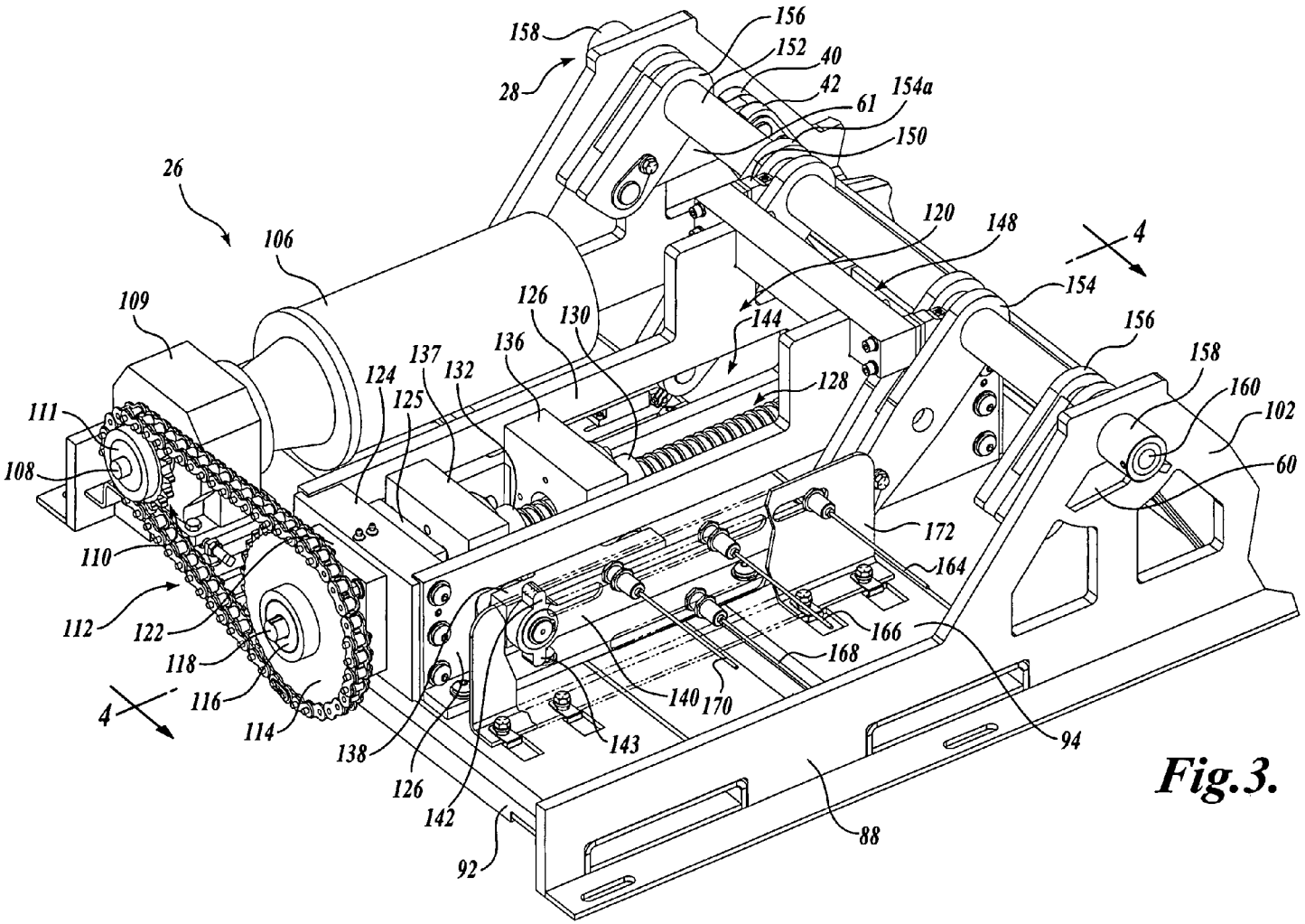
FIG. 3 is a partial isometric view of the platform lift of FIG. 1.

As may be seen best by referring to FIG. 3, lifting means for driving the lift mechanism 24 between a lowered and raised position includes a reversible drive assembly 26, which includes an actuator 120, and a crank assembly 28. The lifting means are positioned relative to the lift mechanism 24 such that the lift mechanism 24 is collapsible within the frame 22. Although illustrated as being adjacent the frame, other configurations may locate the lifting means remotely and independent from the frame. Accordingly, such configurations are within the scope of the present disclosure.

The reversible drive assembly 26 further includes a motor 106. Coupled to the motor 106 is any suitable transmission, such as a gear assembly, a sprocket assembly, etc. Preferably, a gear reducer 109 is coupled to the motor 106 for translating the motor's energy into the rotation of the output shaft 108. The output shaft 108 drives a tapered bushing 111 and an output sprocket 110 coaxially mounted thereon. A roller chain 112 extends between the output sprocket 110 and a drive sprocket 114 for transmitting torque to the drive sprocket 114.

Figure 4:
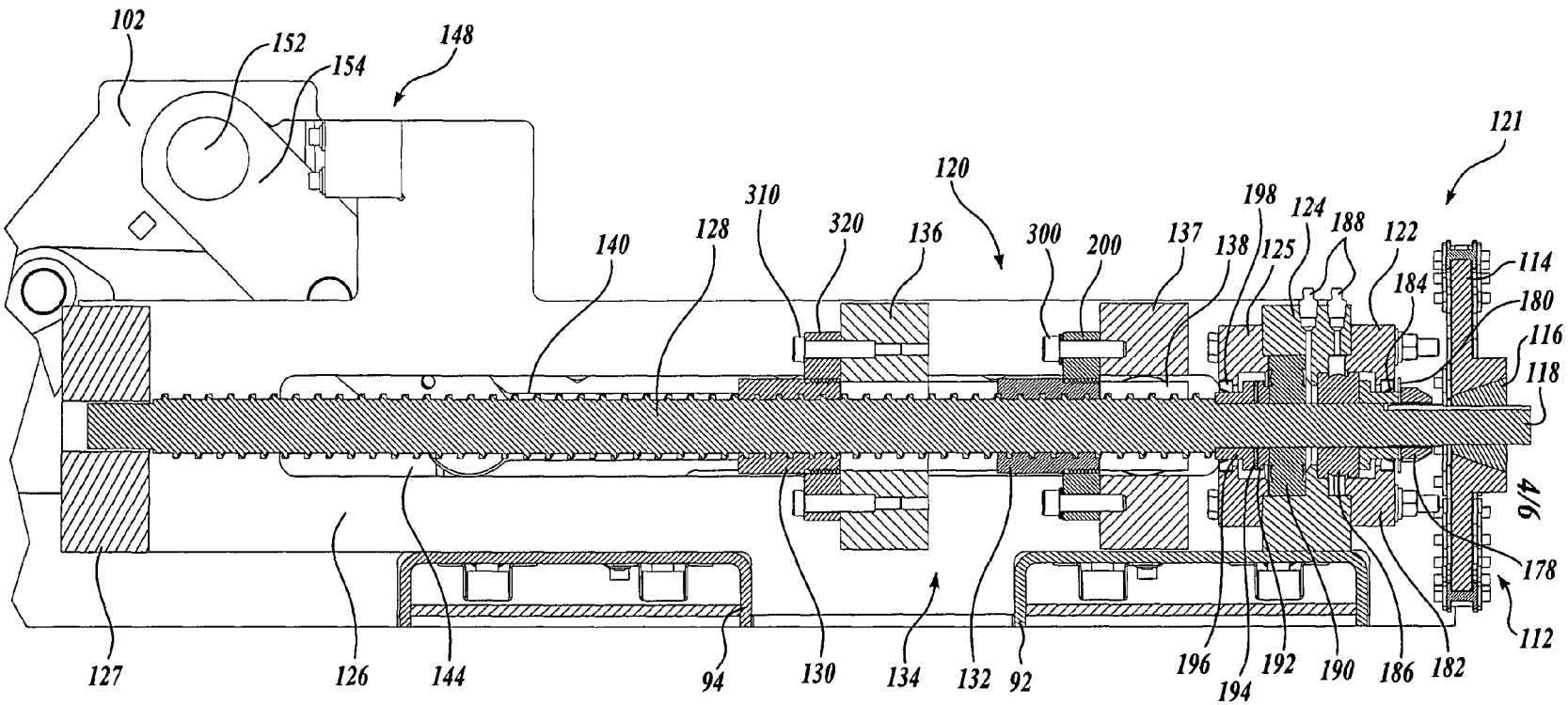
FIG. 4 is a partial cross-sectional view of the platform lift of FIG. 1, taken substantially through Section 4-4 of FIG. 3.

Referring to FIGS. 3 and 4, the actuator 120 is driven by the drive sprocket 114. The drive sprocket 114 and a tapered bushing 116 are coaxially mounted to a screw drive shaft 118. The screw drive shaft 118 forms the end of a lead screw 128, which extends between the drive sprocket 114 and a lead screw end block 127. In an alternate embodiment, the drive assembly 26 includes a motor 106, which is directly coupled to the screw drive shaft 118, either with or without an intermediate gear assembly, but without the use of chains or belts.

The screw drive shaft 118 is at least partially encased within a screw bearing assembly 121, as can best be seen by referring to FIG. 4. The bearing assembly 121 includes a first seal holder 122 coaxially disposed on the screw drive shaft 118, which encases a first thrust spacer 182 and a grease seal 184. The grease seal 184 is disposed within the gap defined by the thrust spacer 182 and the opening of the first seal holder 122. A thrust bearing lock washer 180 is positioned adjacent the first thrust spacer 182 on the exterior of the first seal holder 122, and a thrust bearing lock nut 178 is positioned adjacent the thrust bearing lock washer 180 on the screw drive shaft 118.

Disposed coaxially on the screw drive shaft 118 adjacent the first seal holder 122 is a bearing support 124. Encased within the bearing support 124 and partially within the first seal holder 122 (adjacent the first thrust spacer 182) is a thrust ball bearing 186. Also disposed within the bearing support 124 is a radial ball bearing 190. A plurality of lubrication fittings 188 are integrated within the bearing support 124 to provide the bearing assembly 121 with the proper lubrication.

Disposed coaxially on the screw drive shaft 118 adjacent the bearing support 124 is a second seal holder 125. The second seal holder 125 encases a second thrust spacer 192 that abuts a portion of the radial ball bearing 190 and a third thrust spacer 196 that is positioned adjacent thereto. A grease seal 198 is disposed within the gap defined by the third thrust spacer 196 and the opening of the second seal holder 125. A disc spring 194 is disposed between the second thrust spacer 192 and the third thrust spacer 196.

The first seal holder 122, the bearing support 124, and the second seal holder 125 are coupled together with any suitable fasteners, such as screws, etc., to cooperatively form the bearing assembly 121. The screw drive shaft 118 is freely rotatable within the bearing assembly 121.

Still referring to FIG. 4, one screw plate 126 is positioned laterally along each side of the lead screw 128, wherein each screw plate 126 is fixedly coupled at one end to the bearing support 124 and at the other end to the lead screw end block 127. Each screw plate 126 includes a longitudinal slot 144 that extends substantially along the length of the plate 126.

The actuator 120 further includes a pull-block assembly 134 coaxially and threadably disposed on the lead screw 128, which may be threadably translated thereon. The pull-block-assembly 134 includes a first nut 130 and a second nut 132 threadably received on the lead screw 128 (see also FIG. 3). First and second blocks 136 and 137 are coupled to each nut 130 and 132 and are coaxially disposed on the lead screw 128. The blocks 136 and 137 are rigidly coupled together with two roller bearing assemblies 138.

The roller bearing assemblies 138 are positioned laterally on each side of the pull-block assembly 134 and extend through the longitudinal slots 144. The roller bearing assemblies 138 preferably include a plurality of roller bearings (not shown) disposed within a bearing frame. When the pull-block assembly 134 is threadably translated along the lead screw 128, the roller bearing assemblies 138 translate within the longitudinal slots 144. The roller bearing assemblies 138 translating within the slots 144 provide the reaction torque for first and second nuts 130 and 132.

Figure 5:
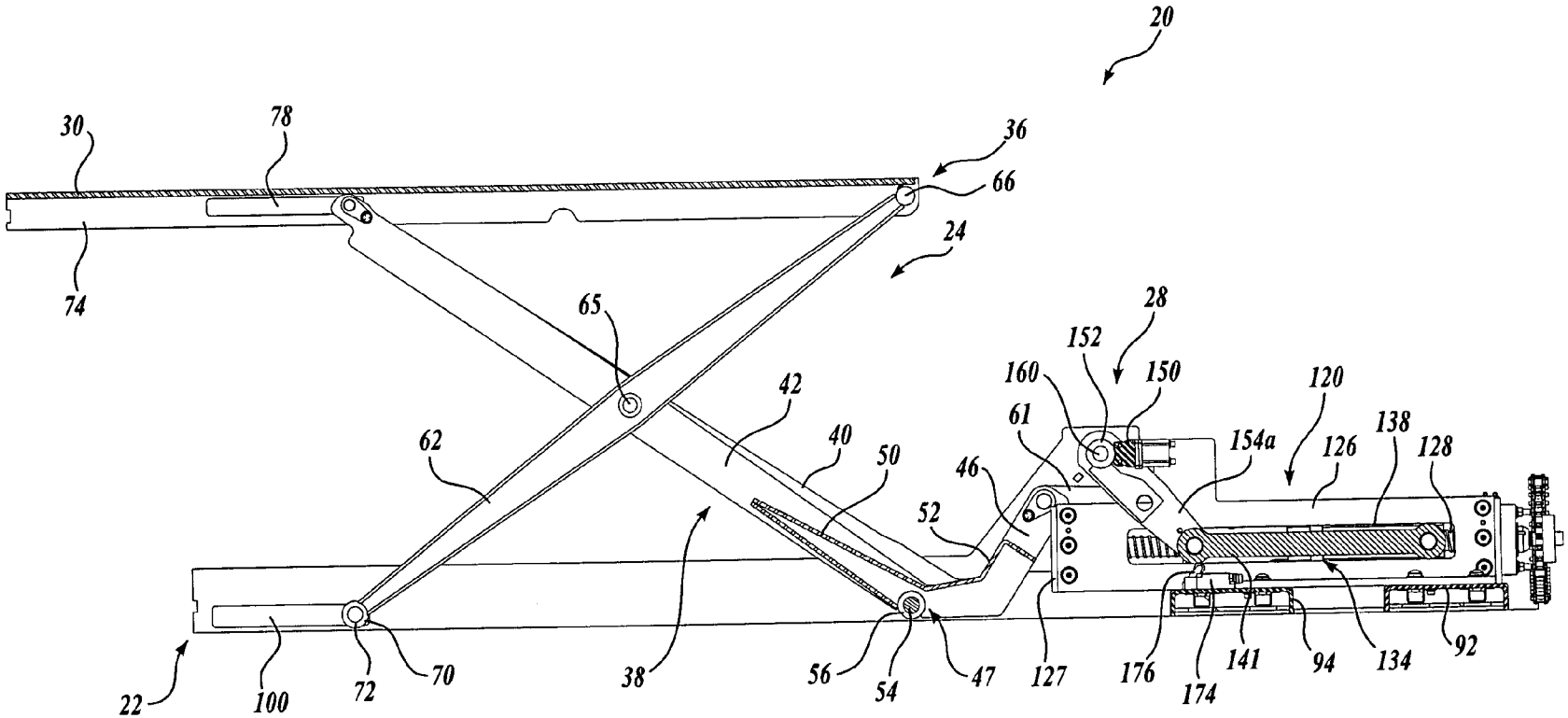
FIG. 5 is a partial cross-sectional view of the platform lift of FIG. 1, taken substantially through Section 6-6 of FIG. 1 and showing the platform lift in the raised position.

Referring to FIG. 5, first and second connecting links 140 and 141 are pivotally coupled at their first ends to the roller bearing assemblies 138. Each connecting link 140 and 141 extends towards the lead screw end block 127. The connecting links 140 and 141 are pivotally coupled at their second end to an inner yoke 154 of the crank assembly 28.

Although the preferred embodiment of the actuator 120 is depicted using an acme lead screw 128, it should be appreciated that other suitable actuators may be used to drive the crank assembly 28. For instance, a ball screw assembly or a hydraulic actuator may similarly be used without departing from the spirit and scope of the present disclosure.

Referring back to FIG. 3, the crank assembly 28, which is driven by the actuator 120, includes a hollow crankshaft 152 that spans between the upwardly projecting portions 102 on the frame 22. Disposed within the hollow crankshaft 152 is the first end of second pin 160 and a bearing assembly (not shown) therebetween, positioned inside the end of hollow crankshaft 152 such that the hollow crank shaft 152 may rotate freely about the first end of second pin 160. Any suitable bearing assembly, such as a ball bearing assembly or a roller bearing assembly, may be used.

The second ends of the second pins 160 are received within the second pin apertures 104 of the projecting portions 102. The second ends of second pins 160 are thereafter received within second collars 158, which are fixedly coupled to the projecting portions 102 of lateral brackets 88. Retaining pins or similar devices pass transversely through the second ends of the second pins 160 and the second collars 158 to prevent the rotation of the second pins 160 within the second collars 158.

The crank assembly 28 further includes a pair of inner yokes 154 and a pair of outer yokes 156 fixedly coupled to the crankshaft 152. The inner yokes 154 are pivotally coupled to the second ends of the connecting links 140 and 141 (see FIG. 5). The outer yokes 156 are pivotally coupled to pushrods 61, which are in turn pivotally coupled to the bent portions of the main lift arms 38, or the second end 46 (see FIG. 2).

In an alternate embodiment, only one inner yoke 154 and one outer yoke 156 is used. In this embodiment, the pull-block assembly 134 would include only one connecting link 140 that would drive the crank assembly 28, and the lift mechanism 24 would include only one pushrod 61 for translating the main lift arms 38. In yet another embodiment, yokes 154 and 156 could be combined into a pair of compound yokes, such that pushrods 61 and connecting links 140 and 141 act on the same pair of yokes. In still yet another embodiment, a drive assembly 26 could be directly connected between levers 46 and frame 22 and not use pushrods 61 or connecting links 140 and 141.

The crank assembly 28 may be further supported by a bearing assembly 148 coupled to the screw plates 126. The bearing assembly 148 includes two crutch bearings 150 that engage the exposed portion of the crankshaft 152 within the inner yokes 154 to provide transverse support to the crankshaft 152 when it is being actuated. However, it should be appreciated that the crank assembly 28 is fully operable without the support of the crutch bearings 150.

Referring still to FIG. 3, the vertical platform lift 20 further includes a control system for detecting and maintaining the positions of the lift mechanism 24 and for preventing extreme mechanical travel of the lift 20. The control system includes a controller (not shown) and a plurality, such as four, proximity switches 164, 166, 168, and 170. The proximity switches are suitably mounted on a switch bracket 172 received within the frame 22. Preferably, inductive proximity switches or optical sensors are used; however, it can be appreciated that other types of sensors, such as mechanical sensors, may also be used without departing from the spirit and scope of the present disclosure.

The first connecting link 140, positioned adjacent the switch bracket 172, includes first and second knobs 142 and 143. The first and second knobs 142 and 143 are suitably manufactured from a conductive material, such as steel, brass, aluminum, etc., which is detectable by the proximity switches 164-170. The proximity switches are positioned within the switch bracket 172 such that at least the first or second knob 142 and 143 is detectable by a proximity switch 164, 166, 168, or 170 when the connecting link 140 is translated by the pull-block assembly 134.

In use, the drive assembly 26 and at least a portion of the frame 22 are positioned beneath a landing, platform, stair, or other building element (not shown). Thus, the lift 20 can be easily incorporated into new and remodel construction without encroaching on the surrounding walls. The lift mechanism 24 and lift platform 30 extend outwardly from the landing, platform, stair, or building element such that they may be reciprocated between lowered and raised positions. Moreover, the lift mechanism 24 is fully receivable within the frame 22 such that the lift 20 is low-profile when in the lowered position.

In operation, the drive assembly 26 reciprocates the lift mechanism 24 and lift platform 30 between at least the lowered and raised positions. As shown in FIG. 6, the lift platform 30 and lift mechanism 24 are lowered within the frame 22. To reciprocate the lift 20 into a raised position, the motor 106 is activated to rotate the output sprocket 110 and the drive sprocket 114 in the clockwise direction. The rotation of the drive sprocket 114 causes the screw drive shaft 118 and lead screw 128 to rotate about its longitudinal center axis in the clockwise direction within the screw bearing assembly 121.

With the lift mechanism 24 in the lowered position, the pull-block assembly 134 is positioned coaxially on the lead screw 128 such that the roller bearing assemblies 138 abut the rear end of the longitudinal slots 144, as shown in FIG. 6. As stated above, the lead screw 128 is threadably received within the first and second nuts 130 and 132 of the pull-block assembly 134. Thus, the rotation of the lead screw 128 within the first and second nuts 130 and 132 of the pull-block assembly 134 threadably translates the pull-block assembly 134 along the lead screw 128.

The second nut 132 is fixed to pull-block assembly 134 at second block 137 by nut flange 200 and screws 300. The first nut 130 is rotatably fixed to pull-block assembly 134 at first block 136 by nut flange 320 and shoulder screws 310. First nut 130 is translatably free and a gap between nut flange 320 and first block 136 is maintained by the helix of screw 128. As second nut 132 wears, the gap closes. When the gap is fully closed, the first nut 130 begins to bear the load of the screw. A switch (not shown) then actuates as the gap closes, and the control system actuates an alarm and/or shuts down the lift, i.e., removes power. Thus, the first nut 130 acts as a safety device.

To move the lift mechanism 24 from the lowered position toward the raised position, the lead screw 128 rotates clockwise to translate the pull-block assembly 134 linearly along the lead screw 128 toward the drive sprocket 114. The roller bearing assemblies 138 and connecting links 140 and 141 are translated along with the pull-block assembly 134, thereby pulling the inner yokes 154 in a counterclockwise direction and torquing the crankshaft 152 in a counterclockwise direction. The counterclockwise rotation of the crankshaft 152 drives the outer yokes 156 in a counterclockwise direction, thus pulling the pushrod 61 and rotating the second end 46 of the main lift arms 38 clockwise about the lever pivot point 47.

Referring to FIG. 5, the clockwise rotation of the second end 46 causes the main lift arms 38 to rotate in a clockwise direction about the lever pivot point 47 and translate in a generally upward direction. The rotation of the main lift arms 38 about the lever pivot point 47 drives the stabilizing arms 62 in an upward direction as pivot 65 is moved upward. As the main lift arms 38 and stabilizing arms 62 are translated upward, the upper ends of the main lift arms 38 pivot and slide forward within the longitudinal slots 78 of the platform frame 36. Thus, the rod pin ends 72 of the stabilizing arms 62 pivot and slide forward within the longitudinal slots 100 of the frame 22. Furthermore, the upper ends of the stabilizing arms 62 pivot about the axis defined by the connecting rod 66 and pivots 266 with respect to the platform frame 36. The simultaneous movement of the arms 38 and 62 drives the platform 30 into the elevated, raised position, while maintaining the platform 30 substantially level.

As configured, the drive assembly 26 provides a driving force to the main lift arms 38 without providing such a force directly to the stabilizing arms 62. Instead, when the main lift arms 38 are reciprocated into the raised or lowered position by the application of the driving force, the stabilizing arms 62 merely travel with the main lift arms 38 as they are connected. The stabilizing arms 62 assist in maintaining the platform 30 in a level position without being driven by the drive assembly 26.

Now referring to FIG. 6, the drive assembly 26 may be similarly actuated to reciprocate the lift 20 into a lowered position. The drive assembly 26 is reversed. The lead screw 128 rotates in a counterclockwise direction, thereby translating the pull-block assembly 134 and the connecting links 140 and 141 along the screw 128 towards the lead screw end block 127. The translation of the connecting links 140 and 141 drives the inner yokes 154 in a clockwise direction, thereby causing the crankshaft 152 to rotate in a clockwise direction.

The clockwise rotation of the crankshaft 152 drives the outer yokes 156 in a clockwise direction, and the clockwise rotation of the outer yokes 156 urge the pushrod 61 outwardly toward the lift mechanism 24, thereby rotating the second end 46, and the main lift arms 38, in a counterclockwise direction about the lever pivot point 47. The rotation of the main lift arms 38 about the lever pivot point 47 drives the stabilizing arms 62 in a downward direction, thereby collapsing the lift mechanism into the lowered position.

Referring back to FIG. 3, when the lift 20 is reciprocated between the lowered and raised positions, the proximity switches 164-170 detect the position of the lift 20. The proximity switches are suitably electrically connected to the controller (not shown), which regulates power supplied to the drive assembly 26 to maintain the lift mechanism 24 in one of at least multiple positions, such as four positions.

When the lift 20 is in the lowered position (as shown in FIG. 6), the pull-block assembly 134 and connecting links 140 and 141 are positioned on the lead screw 128 such that the upper knob 142 of the first connecting link 140 is in substantial alignment with the first proximity switch 164. The first proximity switch 164 senses the knob 142 and signals the controller that the lift 20 is in the lowered position.

When the lift 20 is reciprocated toward the raised position, the actuator 120 translates the pull-block assembly 134 and connecting links 140 and 141 along the lead screw 128 until the upper knob 142 of the first connecting link 140 comes into substantial alignment with the second proximity switch 166. The second proximity switch 166 senses the upper knob 142 and signals the controller to maintain the lift 20 within a partially raised position.

When the lift 20 is translated further into the fully raised position (as shown in FIG. 5), the upper knob 142 comes into substantial alignment with the fourth proximity switch 170, which signals the controller to maintain the lift 20 in the fully raised position.

When drive assembly 26 is activated to lower the lift 20, the actuator 120 translates the pull-block assembly 134 and connecting links 140 and 141 until the lower knob 143 of the first connecting link 140 substantially aligns the third proximity switch 168 and signals the controller to maintain the lift 20 in a partially lowered position. It should be appreciated that fewer or more proximity switches may be used to control fewer or more positions of the lift mechanism 24.

While the proximity switches 164-170 are used to help maintain the position of the lift 20, a limit switch assembly is used to limit mechanical travel of the lift 20. Referring to FIGS. 5 and 6, the limit switch assembly includes a lever arm 176 and a limit switch 174. The limit switch 174 is activated and shuts down the lift when the lever arm 176 travels a predetermined distance in the clockwise direction. Thus, when the inner yoke 154*a* is rotated in a counterclockwise direction by the first and second connecting links 140 and 141, the inner yoke 154*a* engages the lever arm 176 and urges the lever arm 176 in a clockwise direction.

If the connecting link 140 translates the inner yoke 154*a* past a predetermined position, the lever arm 176 actuates the switching mechanism within the limit switch 174 to shut down the lift 20. Thus, the limit switch 174 minimizes the risk of extreme mechanical travel of inner yokes 154, thereby preventing the crank assembly 28 from reciprocating the lift 20 beyond an extreme raised position.

While illustrative embodiments have been illustrated and described, it will be appreciated that various changes can be made therein without departing from the spirit and scope of the invention. As a non-limiting example, the lift mechanism 24 may be actuated by a reversible rotary drive, a hydraulic actuator, or the like attached to the first pin 54 to reciprocate the platform 30 between the raised and lowered positions. Such an embodiment results in main lift arms 38 that do not include the bent second end 46. Thus, although in certain embodiments it is desirable that the lift arms 38 act like a lever to reciprocate the platform, other configurations are also within the scope of the present disclosure. As such, it is intended that the claims be construed to include such embodiments. Further, it should be apparent that directional terms, such as clockwise, counterclockwise, upper, lower, inner, outer, etc., are used throughout as a matter of convenience and are not intended to be limiting.

The embodiments of the invention in which an exclusive property or privilege is claimed are defined as follows:

1. A wheelchair lift assembly, comprising:

(a) a frame;

(b) a platform;

(c) a lift mechanism associated with the frame, the lift mechanism including:

(i) at least one lift arm member having a first end opposite a second end, the first end being coupled to the platform, the at least one lift arm member including a lever pivot point disposed between the first and second ends and fixedly located relative to the frame, the first end pivoting and translating relative to the platform as the platform is reciprocated between raised and lowered positions; and (ii) a stabilizing arm; and (d) a drive assembly comprising:

(i) a crankshaft rotatable about a first axis of rotation, the first axis of rotation having a fixed position relative to the frame;

(ii) an actuator for selectively rotating the crankshaft;

(iii) a yoke extending radially from the crankshaft; and (iv) a pushrod pivotally connected at a first end to the second end of the at least one lift arm member, a second end of the pushrod being pivotally coupled to the yoke about a second axis of rotation, the second axis of rotation maintaining a fixed distance from the first axis of rotation, wherein rotation of the crankshaft moves the second end of the pushrod along an arcuate path around the first axis of rotation to provide a driving force to the lift mechanism.

2. The wheelchair lift assembly of claim 1, wherein the at least one lift arm member acts as a lever about the lever pivot point to reciprocate the platform between raised and lowered positions.

3. The wheelchair lift of assembly of claim 1, wherein the drive assembly selectively provides the driving force without directly providing the driving force to the stabilizing arm.

4. The wheelchair lift assembly of claim 1, wherein the actuator comprises a pull-block assembly.

5. The wheelchair lift assembly of claim 4, wherein the pull-block assembly includes a safety device.

6. The wheelchair lift assembly of claim 5, wherein the safety device is adapted to actuate an alarm and/or shut down operation of the wheelchair lift assembly if a predetermined condition occurs.

7. The wheelchair lift assembly of claim 4, wherein a portion of the pull-block assembly is coupled to the crankshaft to rotate the crankshaft.

8. The wheelchair lift assembly of claim 7, further comprising a limit switch assembly for limiting travel of the platform as the platform is reciprocated into the raised position.

9. The wheelchair lift assembly of claim 4, further comprising at least one sensor for sensing movement of a portion of the lift mechanism.

10. The wheelchair lift assembly of claim 9, wherein the at least one sensor is adapted to limit movement of the lift mechanism as a function of a position of the pull-block assembly.

11. The wheelchair lift assembly of claim 1, further comprising a sensor for sensing movement of a portion of the lift mechanism.

12. The wheelchair lift assembly of claim 1, further comprising a limit switch assembly adapted to limit travel of the platform as the platform is being reciprocated into the raised position.

13. The wheelchair lift assembly of claim 1, wherein the first axis of rotation is positioned higher than the platform when the platform is in the lowered position.

14. The wheelchair lift assembly of claim 13, wherein the first axis of rotation is disposed lateral to the platform.

15. A wheelchair lift assembly, comprising:

(a) a frame;

(b) a lift mechanism associated with the frame, the lift mechanism including:

(i) first and second lift arm members, each of the first and second lift arm members having a first end opposite a second end, each first end being coupled to a platform, wherein the first end of each of the first and second lift arm members simultaneously pivots and translates relative to the platform as the platform is reciprocated between raised and lowered positions, each of the first and second lift arm members having a lever pivot point disposed between the first and second ends and fixedly located relative to the frame; and (ii) a first stabilizing arm coupled to the first lift arm member and a second stabilizing arm coupled to the second lift arm member; and (c) a drive assembly comprising:

(i) a crankshaft rotatable about a first axis of rotation, the first axis of rotation having a fixed portion relative to the frame;

(ii) an actuator for selectively rotating the crankshaft;

(iii) a yoke coupled at a first end to the crankshaft and extending radially from the crankshaft; and (iv) a pushrod pivotally connected at a first end to the second end of the first lift arm member, a second end of the pushrod being pivotally coupled to a second end of the yoke about a second axis of rotation, the second axis of rotation being disposed a fixed distance from the first axis of rotation, wherein rotation of the crankshaft moves the second axis of rotation along a circular path to provide a driving force to the lift mechanism without directly providing the driving force to either of the first or second stabilizing arms.

16. The wheelchair lift of claim 15, wherein the first lift arm member acts as lever about the lever pivot point to reciprocate the platform between the raised and lowered positions.

17. The wheelchair lift of claim 15, further comprising a safety device in communication with the drive assembly and adapted to actuate an alarm and/or prevent operation of the wheelchair lift assembly if a predetermined condition occurs.

18. The wheelchair lift assembly of claim 15, further comprising at least one sensor for sensing movement of a portion of the lift mechanism.

19. The wheelchair lift assembly of claim 18, further comprising a limit switch assembly adapted to limit travel of the platform as the platform is being reciprocated into the raised position.

20. The wheelchair lift assembly of claim 15, wherein the first axis of rotation is positioned higher than the platform when the platform is in the lowered position.

21. The wheelchair lift assembly of claim 20, wherein the first axis of rotation is disposed lateral to the platform.

22. A wheelchair lift assembly, comprising:

(a) a frame;

(b) a platform;

(c) a lift mechanism associated with the frame, the lift mechanism including:

(i) at least one lift arm member having a first end opposite a second end, the first end being coupled to the platform, the at least one lift arm member including a lever pivot point disposed between the first and second ends and fixedly located relative to the frame, the first end pivoting and translating relative to the platform as the platform is reciprocated between raised and lowered positions; and (ii) a stabilizing arm; and (d) a drive assembly comprising:

(i) a crankshaft rotatable about a first axis of rotation, the first axis of rotation being fixed relative to the frame;

(ii) an actuator for selectively rotating the crankshaft;

(iii) a yoke coupled at a first end to the crankshaft and extending radially from the crankshaft; and (iv) a pushrod pivotally connected at a first end to the second end of the at least one lift arm member, a second end of the pushrod being pivotally coupled to a second end of the yoke about a second axis of rotation, the second axis of rotation being disposed a fixed distance from the first axis of rotation, wherein rotation of the crankshaft moves the second axis of rotation along a circular path to provide a driving force to the lift mechanism without directly providing the driving force to the stabilizing arm, wherein the at least one lift arm member acts as a lever about the lever pivot point to reciprocate the platform between the raised and lowered positions.

23. The wheelchair lift assembly of claim 22, further comprising a safety device in communication with the drive assembly and adapted to actuate an alarm and/or prevent operation of the wheelchair lift assembly if a predetermined condition occurs.

24. The wheelchair lift assembly of claim 22, further comprising at least one sensor for sensing movement of a portion of the lift mechanism.

25. The wheelchair lift assembly of claim 22, further comprising a limit switch assembly adapted to limit travel of the platform as the platform is being reciprocated into the raised position. rotation is disposed lateral to the platform.

26. The wheelchair lift assembly of claim 22, wherein the first axis of rotation is positioned higher than the platform when the platform is in the lowered position.

27. The wheelchair lift assembly of claim 26, wherein the first axis of rotation is disposed lateral to the platform.

* * * * *

UNITED STATES PATENT AND TRADEMARK OFFICE

CERTIFICATE OF CORRECTION

PATENT NO. : 7,896,134 B2
APPLICATION NO. : 11/590247
DATED : March 1, 2011
INVENTOR(S) : D. Morris et al.

It is certified that error appears in the above-identified patent and that said Letters Patent is hereby corrected as shown below:

| COLUMN | LINE | ERROR |
|---|---|---|
| 9<br>(Claim 3, line 1) | 54 | "lift of assembly" should read<br>--lift assembly-- |
| 12<br>(Claim 25, line 4) | 23 | delete "rotation is disposed lateral to the platform." |

Signed and Sealed this
Thirty-first Day of May, 2011

David J. Kappos

David J. Kappos
*Director of the United States Patent and Trademark Office*